US006070971A

United States Patent [19]

Usui et al.

[11] Patent Number: 6,070,971

[45] Date of Patent: Jun. 6, 2000

[54] ACTUATOR FOR INK JET PRINTER

[75] Inventors: Minoru Usui, Shiojiri; Takahiro Katakura, Okaya; Munehide Kanaya, Matsumoto; Motonori Okumura, Suwa; Tomohiro Yamada, Komaki; Shinsuke Yano, Nagoya, all of Japan

[73] Assignees: Seiko Epson Corporation; NGK Insulators, Ltd., both of Japan

[21] Appl. No.: 08/932,259

[22] Filed: Sep. 22, 1997

[30] Foreign Application Priority Data

Sep. 25, 1996 [JP] Japan ..... 8-253401

[51] Int. Cl.[7] ..... B41J 2/045

[52] U.S. Cl. ..... 347/70; 347/54

[58] Field of Search ..... 347/68–72; 310/328–331; 29/890.1

[56] References Cited

U.S. PATENT DOCUMENTS 3,739,299 6/1973 Adler ..... 310/331
5,719,607 2/1998 Hasegawa et al. ..... 347/70

OTHER PUBLICATIONS

Patent Abstracts Of Japan; vol. 7, No. 25 (M–190) '1170!; Feb. 2, 1983 & JP 57 181873 A (T. Oohori); Nov. 9, 1982 *abstract*.

Patent Abstracts Of Japan; vol. 7, No. 25 (M–190) '1170!; Feb. 2, 1983 & JP 57 181874 A (T. Oohori); Nov. 9, 1982 *abstract*.

Patent Abstracts Of Japan; vol. 7, No. 47 (M–196); Feb. 24, 1983 & JP 57 197175 A (Masaru Inoue; Dec. 3, 1982 *abstract*.

Patent Abstracts Of Japan; vol. 11, No. 196 (M–601) '2643!; Jun. 24, 1987 & JP 62 019465 A (T. Isayama); Jan. 28, 1987 *abstract*.

*Primary Examiner*—John Barlow
*Assistant Examiner*—Raquel Yvette Gordon
*Attorney, Agent, or Firm*—Parkhurst & Wendel, L.L.P.

[57] ABSTRACT

An actuator for an ink jet printer includes: an ink tank comprising a thick substrate having a cavity structure and a vibrating plate covering a cavity; and a piezoelectric/electrostrictive working portion comprising an upper electrode layer, a lower electrode layer, and a piezoelectric/electrostrictive layer between the electrode layers, the piezoelectric/electrostrictive working portion being disposed on the ink tank so that the lower electrode layer contacts with the vibrating plate. The upper electrode is trimmed only in the portion where the piezoelectric/electrostrictive layer covers the vibrating plate so as to control an effective electrode area and adjust an ink jet volume to be appropriate. The upper electrode layer is trimmed with the piezoelectric/electrostrictive layer covering the vibrating plate at least near the portion to be trimmed of the upper electrode layer so as to control an effective electrode area and adjust an ink jet volume.

36 Claims, 4 Drawing Sheets

ACTUATOR FOR INK JET PRINTER

BACKGROUND OF THE INVENTION AND RELATED ART STATEMENT

The present invention relates to an actuator for an ink jet printer.

An actuator for an ink jet printer is an ink pump of a print head used for an ink jet printer. An actuator having a structure as shown in FIG. 3 has generally been used. In FIG. 3, an actuator 1 for an ink jet printer is constituted of an ink tank 28 and a piezoelectric/electrostrictive working portion 26. The ink tank 28 is obtained by unitarily forming a thick substrate 21 having a cavity 20 and a vibrating plate 22 covering the cavity 20. The piezoelectric/electrostrictive working portion 26 is constituted of a piezoelectric/electrostrictive layer 24, the upper electrode layer 25 formed on the upper surface of the piezoelectric/electrostrictive layer 24, and the lower electrode layer 23 formed on the lower surface of the piezoelectric/electrostrictive layer 24. The piezoelectric/electrostrictive working portion 26 is disposed on the ink tank 28 so that the lower electrode layer 23 contacts with the vibrating plate 22 of the ink tank 28.

When an electric field is generated between the upper electrode layer 25 and the lower electrode layer 23, a piezoelectric/electrostrictive layer 24 made of a piezoelectric/electrostrictive functional member is transformed and a capacity of the cavity 20 is decreased. Accordingly, ink with which the ink tank 28 is filled is jetted out of a nozzle hole (not shown) being connected with the cavity 20 for printing. An ink jet printer is formed by appropriately disposing a predetermined number of actuators 1 having such a structure.

In such an actuator for an ink jet printer, variance in ink jet volume cause variance in a size of a dot upon printing, and an image having high quality cannot be obtained. Accordingly, it is necessary to uniformalize an ink jet volume from each nozzle hole. For example, Japanese Patent Laid-Open 61-118261 discloses a multi-nozzle head for an ink jet printer, in which an electrode surface of a piezoelectric element for promoting vibrations of a head is trimmed so as to change impedance of the piezoelectric element, thereby uniformalizing an ink jet volume.

By the way, in the aforementioned actuator for an ink jet printer, the vibrating plate 22 covering the cavity 20 is thin and is prone to break. Accordingly, when a laser to be generally used for trimming is directly irradiated to the vibrating plate 22, the vibrating plate 22 breaks and its durability deteriorates. Therefore, it is necessary not to irradiate laser directly to the vibrating plate 22. Additionally, a cavity 20, an ink tank 28, and a piezoelectric/electrostrictive working portion 26 are very minute, and it is practically difficult to dispose and form an actuator so that a piezoelectric/electrostrictive layer 24 precisely covers the whole surface of the vibrating plate 22.

Accordingly, the present invention solves the aforementioned problems and aims to provide an actuator for an ink jet printer in which a laser is precisely controlled and only a portion where a piezoelectric/electrostrictive layer covers the vibrating plate is trimmed. Further, the present invention aims to provide an actuator for an ink jet printer, which can conduct trimming by a laser without having breakage of the vibrating plate.

SUMMARY OF THE INVENTION

According to the present invention, there is provided an actuator for an ink jet printer comprising:

an ink tank comprising a thick substrate having a cavity and a vibrating plate covering the cavity; and a piezoelectric/electrostrictive working portion comprising an upper electrode layer, a lower electrode layer, and a piezoelectric/electrostrictive layer between the electrode layers, the piezoelectric/electrostrictive working portion being disposed on the ink tank so that the lower electrode layer contacts with the vibrating plate;

wherein the upper electrode is trimmed only in the portion where the piezoelectric/electrostrictive layer covers the vibrating plate so as to control an effective electrode area and adjust an ink jet volume.

According to the present invention, there is further provided an actuator for an ink jet printer comprising:

an ink tank comprising a thick substrate having a cavity and a vibrating plate covering the cavity; and a piezoelectric/electrostrictive working portion comprising an upper electrode layer, a lower electrode layer, and a piezoelectric/electrostrictive layer between the electrode layers, the piezoelectric/electrostrictive working portion being disposed on the ink tank so that the lower electrode layer contacts with the vibrating plate;

wherein the upper electrode layer is trimmed with the piezoelectric/electrostrictive layer covering the vibrating plate at least near the portion to be trimmed of the upper electrode layer so as to control an effective electrode area and adjust an ink jet volume.

Incidentally, in the present invention, the piezoelectric/electrostrictive layer preferably has a larger plane area than the upper electrode layer.

In an actuator for an ink jet printer of the present invention, an area to be removed by trimming is calculated in advance among the area where an opening portion of the cavity, the vibrating plate, and the upper electrode layer are piled so as to realize an appropriate ink Jet volume, and to the area was added an area of a portion of the upper electrode layer, the portion being exposed to a direction of an edge of the thick substrate so as to actually remove the total area.

BRIEF DESCRIPTION OF THE DRAWINGS

FIG. 1(*a*) is a plan view, and FIG. 1(*b*) is a cross-sectional view.

DETAILED DESCRIPTION OF THE PREFERRED EMBODIMENT

An actuator for an ink jet printer of the present invention is hereinbelow described in detail with reference to drawings.

Figure 1:
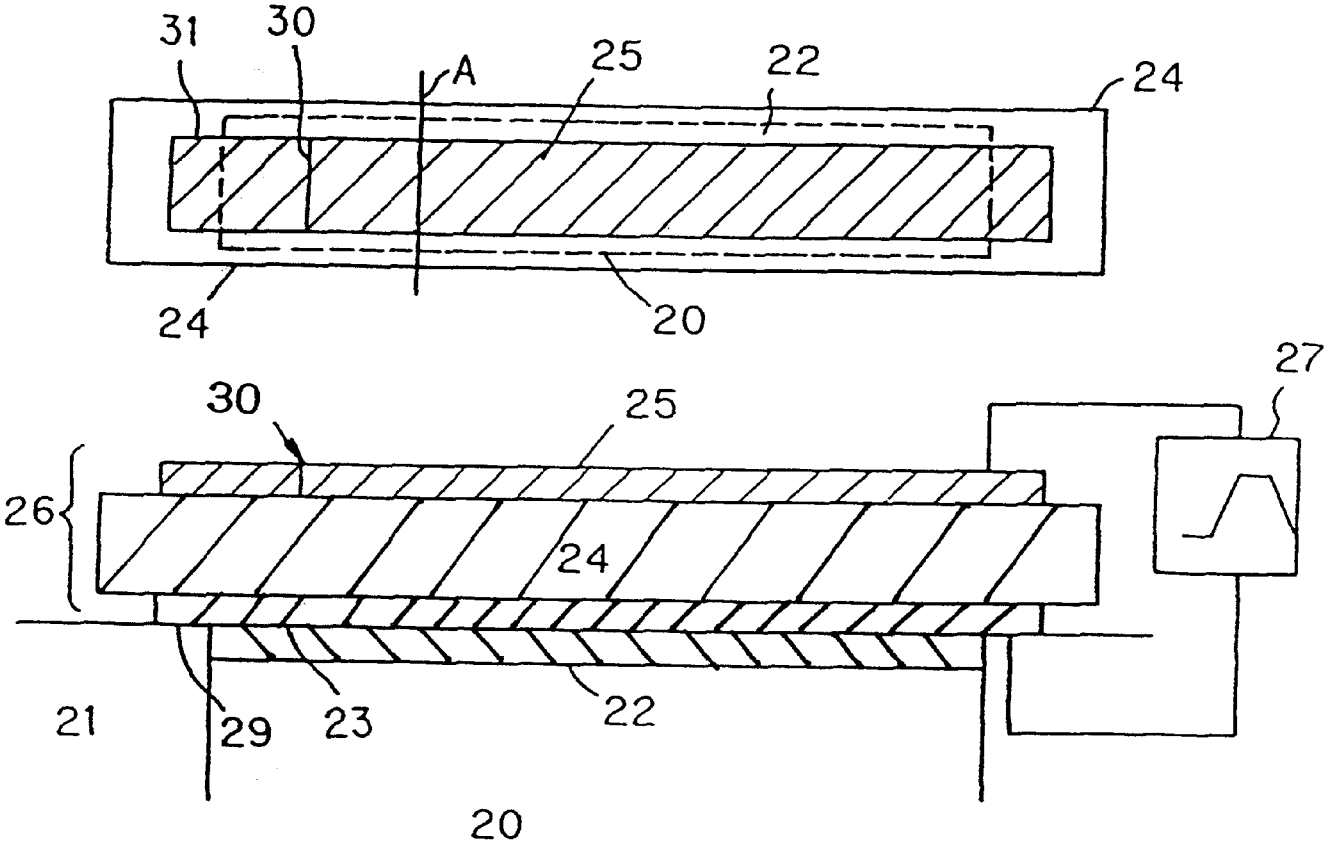
FIGS. 1(*a*) and 1(*b*) are structural views showing an embodiment of an actuator of the present invention.

FIGS. 1(*a*) and 1(*b*) are structural views showing an embodiment of an actuator of the present invention. FIG. 1(*a*) is a plan view, and FIG. 1(*b*) is a cross-sectional view. In FIGS. 1(*a*) and 1(*b*), a thick substrate 21 has a cavity 20. A vibrating plate 22 is formed unitarily with the thick substrate 21 so that the vibrating plate 22 covers the cavity 20. On the upper surface of the vibrating plate 22 were superposed a lower electrode 23, a piezoelectric/electrostrictive layer 24, and an upper electrode layer 25 in this order so as to form a piezoelectric/electrostrictive working portion 26.

The upper electrode layer 25 is cut by trimming at a line 30 which connects a point on a longer side with a point on another longer side. As a result, an effective electrode area is reduced, and the effective electrode area can be controlled. In this case, a portion partitioned by the line 30 may be removed by trimming.

Figure 2:
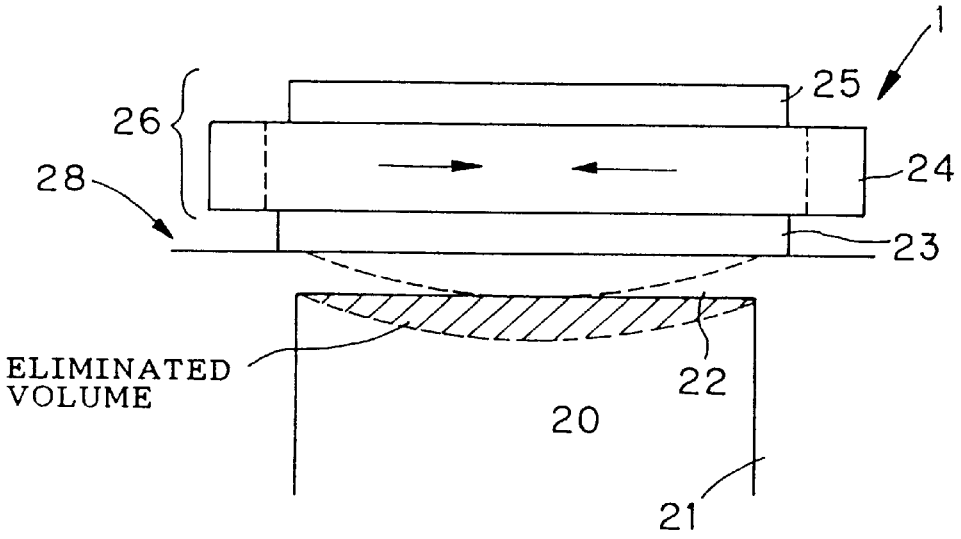
FIG. 2 is an explanatory view showing a state of a transformed actuator of the present invention.
Figure 3:
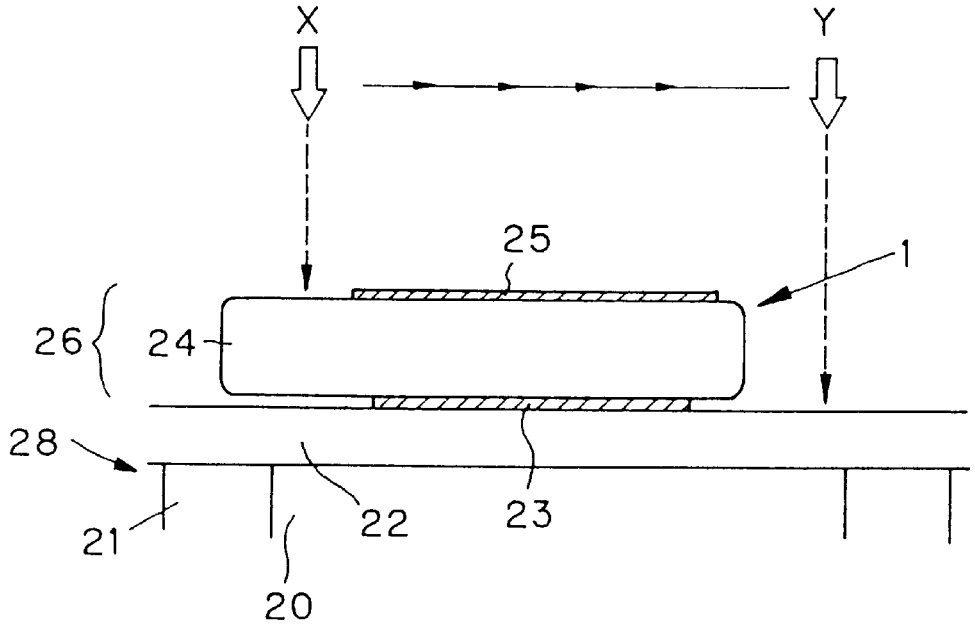
FIG. 3 is a cross-sectional view showing an embodiment of a conventional actuator.

In such a structure, when a voltage is applied between the upper electrode layer 25 and the lower electrode layer 23 by an electric source 27 as shown in FIG. 2, a piezoelectric/electrostrictive layer 24 is transformed in the direction of the cavity 20. A volume of the transformation (an eliminated volume from the cavity 20) can be adjusted, and therefore, properties of ink jet from each of the nozzle holes can be maintained uniformly.

In the actuator 1 of FIG. 1, since the upper electrode layer 25 has a rectangular shape, an area to be removed by trimming can be easily calculated when an effective electrode area is controlled to be adequate. That is, if the upper electrode layer 25 is rectangular, an area to be removed by, for example, cutting at the line 30 by trimming can be very easily calculated. However, when the upper electrode layer 25 has another shape, for example, a circular shape, a calculation of an area to be removed is a little complex in the case of cutting at a line by trimming. Incidentally, a rectangular shape includes not only a shape of rectangle but also a shape with rounded vertical angles.

Figure 4:
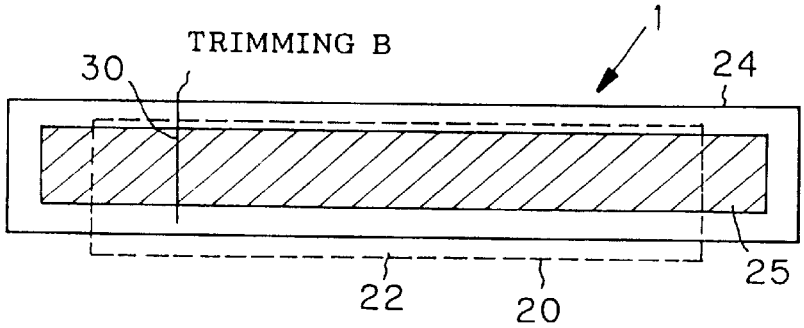
FIG. 4 is a plan view showing another embodiment of an actuator of the present invention.

Since the actuator 1 is very minute as described above, it is difficult to dispose and form the actuator 1 so that the piezoelectric/electrostrictive layer 24 precisely covers the whole surface of the vibrating plate 22. Accordingly, it happens that a piezoelectric/electrostrictive layer 24 does not cover the whole surface of the vibrating plate 22 as shown in FIG. 4 and covers only one side of the vibrating plate 22 (cavity 20). Since even one side of the vibrating plate 22 (cavity 20) is covered, it seldom happens that a laser is directly irradiated to the vibrating plate 22, and the vibrating plate 22 is not broken by a laser trimming B beyond the piezoelectric/electrostrictive layer 24 only in a portion covered by the piezoelectric/electrostrictive layer 24 by trimming only a portion where the piezoelectric/electrostrictive layer 24 covers the vibrating plate 22 by a laser with a precise control.

Figure 5:
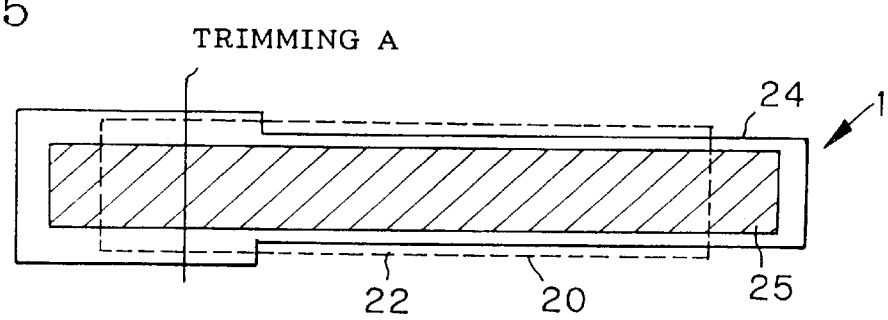
FIG. 5 is a plan view showing still another embodiment of an actuator of the present invention.

Further, in an actuator 1 of FIG. 1, the piezoelectric/electrostrictive layer 24 preferably covers the vibrating plate 22 on an extension line of the line 30 (ref. FIG. 5). The piezoelectric/electrostrictive layer 24 more preferably covers the whole surface of the vibrating plate 22. Thus, by forming the piezoelectric/electrostrictive layer 24 so that the piezoelectric/electrostrictive layer 24 covers the vibrating plate 22 at least on an extended line of the line 30, the vibrating plate 22 is not broken even if trimming A is given not only to a portion of the upper electrode layer 25 but also to a portion beyond the upper electrode layer 25 because a laser beam is intercepted by the piezoelectric/electrostrictive layer 24 and not irradiated to the thin vibrating plate 22 as shown in FIGS. 1(*a*) and 5.

Figure 10:
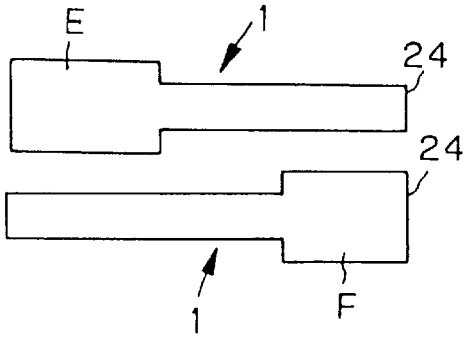
FIG. 10 is a plan view showing yet another embodiment of an actuator of the present invention.

As shown in FIG. 10, by alternately forming piezoelectric/electrostrictive layers 24 to be large in a vertical direction in the Figure (that is, widely) in sides E and F to be subjected to laser trimming as piezoelectric/electrostrictive layers 24 of adjacent actuators 1, a breakage of the vibrating plate 22 can be avoided and many actuators 1 can be disposed without deteriorating a density of actuators 1 for an ink jet printer.

An area to be removed by trimming so as to realize an appropriate ink jet volume is calculated in advance among the portion where an opening of the cavity 20, the vibrating plate 22, and the upper electrode layer 25 are piled up. In an actuator 1 of the present invention, the upper electrode layer 25 is protruded from the vibrating plate 22 in the direction of an edge 29 of the thick substrate 21. Accordingly, an ink jet volume is not influenced even if this portion is removed by trimming. Accordingly, an area to be actually removed should be determined in consideration of the area of this portion. That is, when the upper electrode layer 25 is separated at a line connecting a point on a longer side with a point on the other longer side, a value obtained by adding an area of the portion 31 where the upper electrode layer 25 is protruded from the vibrating plate 22 is preferably added to the above calculated value so as to obtain an actual area to be removed.

Figure 6:
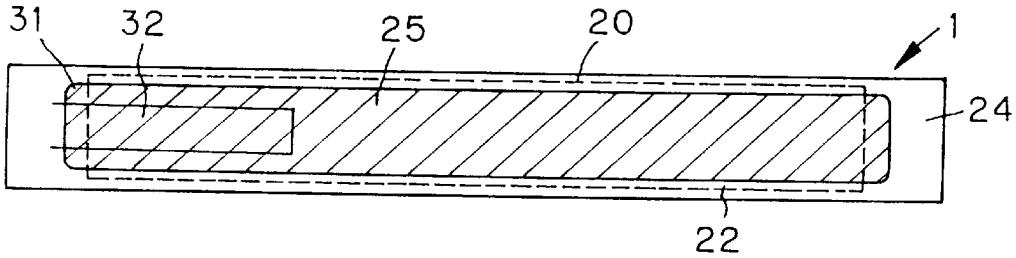
FIG. 6 is a plan view showing yet another embodiment of an actuator of the present invention.

FIG. 6 is a plan view showing another embodiment of an actuator of the present invention. In FIG. 6, a notch 32 is formed by trimming along a shorter side of the upper electrode layer 25. By forming the notch 32, the area is removed from an effective electrode area, and an ink jet volume can be adjusted to be appropriate. Preferably, there is only one notch having a rectangular shape. In this case, a portion where the upper electrode layer 25 is protruded from the vibrating plate 22 is trimmed in the direction of an edge of the thick substrate 21. Accordingly, an actual area to be removed should be determined in consideration of an area of this portion. However, this actuator has an advantage over the actuator shown in FIG. 1 in having smaller ratio of a portion which does not influence an ink jet volume in an area to be removed. Incidentally, in an actuator shown in FIG. 6, a laser beam is not irradiated to the vibrating plate 22 even if a trimming is beyond the upper electrode layer 25. Accordingly, a piezoelectric/electrostrictive layer 24 does not have to cover the vibrating plate 22.

Figure 7:
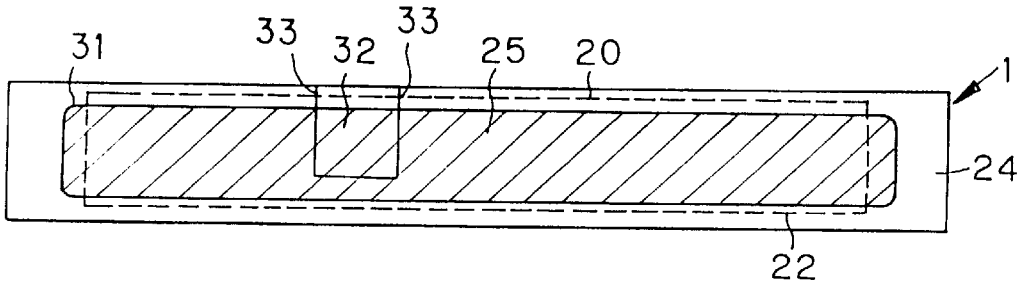
FIG. 7 is a plan view showing yet another embodiment of an actuator of the present invention.
Figure 8:
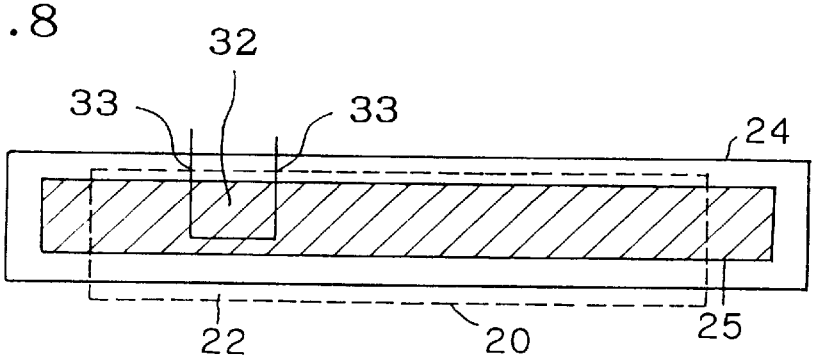
FIG. 8 is a plan view showing yet another embodiment of an actuator of the present invention.

FIG. 7 is a plan view showing still another embodiment of an actuator of the present invention. In FIG. 7, a notch 32 is formed by trimming along a longer side of the upper electrode layer 25. A number of notch is at least one, and a shape is preferably rectangular. Each longer side may have a notch. In an actuator shown in FIG. 7, a portion where the upper electrode layer 25 is protruded from the vibrating plate 22 in a direction of an edge of the thick substrate 21 is not trimmed. An actual area to be removed can be determined by a value obtained from the relation between an ink jet volume and an area of a portion where an opening of the cavity 20, the vibrating plate 22, and the upper electrode layer 25 are piled up. On the other hand, when the trimming is given beyond the upper electrode layer 25, the vibrating plate 22 may break depending on a condition that the piezoelectric/electrostrictive layer 24 covers the vibrating plate 22 (cavity 20). Accordingly, the piezoelectric/electrostrictive layer 24 preferably covers the vibrating plate 22 at least near the intersecting point 33 formed by a periphery of the notch 32 and the longer side as shown in FIG. 8.

Figure 9:
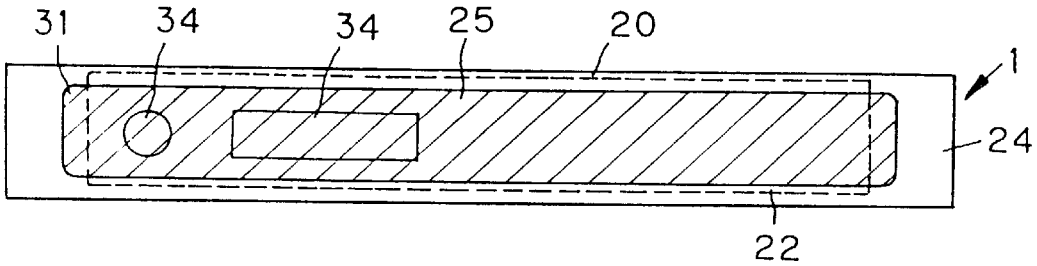
FIG. 9 is a plan view showing yet another embodiment of an actuator of the present invention.

FIG. 9 is a plan view showing yet another embodiment of an actuator of the present invention. In FIG. 9, the upper electrode layer 25 has perforated portions 34 each having an appropriate area formed by trimming. The perforated portions 34 may be cut or removed. The upper electrode layer 25 has at least one perforated portion. Though a shape of a perforated portion 34 is not limited, it is preferably circular or rectangular to meet the convenience of calculating an area to be removed.

In an actuator shown in FIG. 9, a portion where the upper electrode layer 25 is protruded out of the vibrating plate 22 in a direction of an edge of the thick substrate 21 is not trimmed. Accordingly, an actual area to be removed can be determined by a value obtained from the relation between an ink jet volume and an area of the portion where the opening of the cavity 20, the vibrating plate 22, and the upper electrode layer 25 are piled up. Since a laser beam is not irradiated to the vibrating plate 22 upon trimming, a piezoelectric/electrostrictive layer 24 does not have to cover the vibrating plate 22.

In an actuator of the present invention, the thick substrate 21 is usually formed together with the vibrating plate 22 as a unitarily fired article made of ceramic. To be concrete, a ceramic slurry is prepared from a ceramic material, binder, solvent, and the like, and then, a plurality of green sheets are molded out of the ceramic slurry in a known method such as doctor blading. Subsequently, the green sheets are subjected to machining such as cutting, perforating, or the like, so as to form a cavity. The green sheets are piled up to obtain a laminate. Then, the laminate is fired so as to obtain a unitary ceramic fired article.

Though a material constituting the thick substrate 21 and the vibrating plate 22 is not particularly limited, the material is preferably ceramic in view of insulation ability. Further, alumina and zirconia are particularly suitably used in view of molding characteristic. Incidentally, the vibrating plate 22 has a thickness of preferably 50 $\mu$m or less, more preferably 20 $\mu$m or less.

A piezoelectric/electrostrictive working portion 26 is formed by superposing the lower electrode layer 23, a piezoelectric/electrostrictive layer 24, and the upper electrode layer 25 in this order on the upper surface of the vibrating plate 22 generally in a film forming method.

That is, the lower electrode layer 23, the piezoelectric/electrostrictive layer 24, and the upper electrode layer 25 are formed on the outer surface of the vibrating plate 22 by one of various known methods, for example, a thick film forming method such as screen printing, spraying, or the like, or a thin film forming method such as ion beam, sputtering, CVD, or the like.

Each of thus formed films (the lower electrode layer 23, the piezoelectric/electrostrictive layer 24, and the upper electrode layer 25) is subjected to a heat treatment (firing). The heat treatment may be given each time each film is formed. Alternatively, the heat treatment may be given to all the films simultaneously after all the films are formed.

A material for the lower electrode layer 23 and the upper electrode layer 25 constituting a piezoelectric/electrostrictive working portion 26 is not particularly limited as long as it is a conductor withstanding an atmosphere having a high temperature about a degree of a temperature for a heat treatment (firing). For example, the material may be a simple substance of a metal, an alloy, or a conductive ceramic. Specifically, a noble metal having a high melting point such as platinum, gold, palladium, or the like, can be suitably used.

A material for a piezoelectric/electrostrictive layer 24 constituting a piezoelectric/electrostrictive working portion 26 may be any material as long as it shows an electric field inductive strain such as a piezoelectricity, an electrostrictive effect, or the like. Specifically, there is preferably used a material mainly containing plumbum zirconate titanate (PZT type), a material mainly containing plumbum magnesium niobate (PMN type), a material mainly containing plumbum nickel niobate (PNN type), or the like.

The piezoelectric/electrostrictive working portion 26 has a thickness of generally 100 $\mu$m or less. Each of the lower electrode layer 23 and the upper electrode layer 25 has a thickness of generally 20 $\mu$m or less, and preferably 5 $\mu$m or less. The piezoelectric/electrostrictive layer 24 has a thickness of preferably 50 $\mu$m or less, and more preferably within the range from 3 $\mu$m to 40 $\mu$m to obtain a large displacement by low working voltage.

Some modes of the present invention are described above. However, the present invention is not limited to these modes, and it should be understood that various modifications can be made on the basis of knowledge of person of ordinary skill as long as the modifications do not deviate from the object of the present invention.

The present invention is described in more detail with reference to Examples.

EXAMPLE 1

The piezoelectric/electrostrictive layer was formed so as to cover the whole surface of the vibrating plate. The upper electrode layer was subjected to trimming by a laser beyond the upper electrode layer. The vibrating plate was investigated for presence of a crack in a portion where the vibrating plate and the upper electrode layer do not lap each other.

Incidentally, the vibrating plate was made of zirconia and had a thickness of 5 $\mu$m. The piezoelectric/electrostrictive layer was made of PZT and had a thickness of 20 $\mu$m. The upper electrode layer was made of Au and had a thickness of 1 $\mu$m.

As a laser irradiation apparatus, YAG (produced by ESI) was used. The irradiation was performed with a wavelength of 266 nm, a laser speed of 30 mm/sec, a Q rate of 5 kHz, a laser power of 5 mW/2 kHz. The results are shown in Table 1. Incidentally, presence of a crack was expressed by for absence and x for presence. Conditions of trimming were evaluated as for excellent.

EXAMPLE 2

Trimming by a laser was performed in the same manner as in Example 1 except that a laser power was 200 mW/2 kHz. Presence of a crack in the vibrating plate was investigated. The results are shown in Table 1.

COMPARATIVE EXAMPLE 1

The piezoelectric/electrostrictive layer was formed so as to cover only a portion of the vibrating plate. The upper electrode layer was subjected to trimming by a laser beyond the upper electrode layer and the piezoelectric/electrostrictive layer. Presence of a crack in the vibrating plate was investigated in a portion where the vibrating plate and the upper electrode layer or the piezoelectric/electrostrictive layer do not lap each other. Trimming by a laser was performed in the same manner as in Example 1 except that a thickness of the vibrating plate was varied within the range from 5 to 50 $\mu$m. The results are shown in Table 1.

COMPARATIVE EXAMPLES 2–8

Trimming by a laser was performed in the same manner as in Comparative Example 1 except that a laser power was varied within the range from 10 to 200 mW/2 kHz. Presence of a crack in the vibrating plate was investigated. The results are shown in Table 1.

TABLE 1

| | Example | | Comparative Example | | | | | | | |
|---|---|---|---|---|---|---|---|---|---|---|
| | 1 | 2 | 1 | 2 | 3 | 4 | 5 | 6 | 7 | 8 |
| Conditions of trimming | ○ | ○ | ○ | ○ | ○ | ○ | ○ | ○ | ○ | ○ |
| Laser power (mW/2 kHz) | 5 | 200 | 5 | 10 | 15 | 20 | 30 | 50 | 100 | 200 |
| Occurrence of surface crack | ○ | ○ | x | x | x | x | x | x | x | x |
| Occurrence of through crack | | | | | | | | | | |
| 5 | ○ | ○ | ○ | ○ | ○ | ○ | x | x | x | x |
| 10 | — | — | ○ | ○ | ○ | ○ | ○ | ○ | x | x |
| 15 | — | — | ○ | ○ | ○ | ○ | ○ | ○ | x | x |
| 20 | — | — | ○ | ○ | ○ | ○ | ○ | ○ | ○ | x |
| 30 | — | — | ○ | ○ | ○ | ○ | ○ | ○ | ○ | ○ |
| 50 | — | — | ○ | ○ | ○ | ○ | ○ | ○ | ○ | ○ |

Table 1 shows that the vibrating plate did not have a crack even if trimming was performed beyond the upper electrode layer when a piezoelectric/electrostrictive layer covers a vibrating plate.

On the other hand, when a piezoelectric/electrostrictive layer covers only a portion of the vibrating plate, and the upper electrode layer was trimmed by a laser beyond the upper electrode layer and the piezoelectric/electrostrictive layer, and the laser was directly irradiated to the vibrating plate, the vibrating plate had a crack on its surface in any Examples. Further, some vibrating plates had a crack passing through the vibrating plates when the vibrating plate had a certain thickness and a laser power had a certain value.

Since a portion of the upper electrode layer is cut or removed by trimming in an actuator of the present invention, an effective electrode area is controlled so as to have an appropriate value, and a desired ink jet volume can be obtained.

Further, since a piezoelectric/electrostrictive layer covers a vibrating plate near a portion to be trimmed among a periphery of the upper electrode layer, breakage of the vibrating plate by a laser beam can be avoided.

What is claimed is:

1. An actuator for an ink jet printer comprising:

an ink tank comprising a thick substrate having a cavity and a vibrating plate covering the cavity; and a piezoelectric/electrostrictive working portion comprising an upper electrode layer, a lower electrode layer, and a piezoelectric/electrostrictive layer between said electrode layers, the piezoelectric/electrostrictive working portion being disposed on the ink tank so that the lower electrode layer contacts the vibrating plate;

wherein the upper electrode comprises an effective portion and a trimmed or ineffective portion.

2. An actuator for an ink jet printer according to claim 1, wherein the piezoelectric/electrostrictive layer has a larger plane area than the upper electrode layer.

3. An actuator for an ink jet printer according to claim 1, wherein the upper electrode layer has a rectangular shape, and the effective and ineffective portions of the upper electrode layer are separated at a line connecting a point on a longer side with a point on the other longer side or said ineffective portion is removed.

4. An actuator for an ink jet printer according to claim 3, wherein the piezoelectric/electrostrictive layer covers the vibrating plate on an extension line of said line.

5. A method of manufacturing an actuator for an ink jet printer according to claim 3, wherein the piezoelectric/electrostrictive layer covers the vibrating plate on an extension line of said line which partitions said upper electrode layer.

6. An actuator for an ink jet printer according to claim 1, wherein the upper electrode layer has a rectangular shape and at least one notch cut or removed by trimming along a longer side of the upper electrode layer.

7. An actuator for an ink jet printer according to claim 6, wherein the notch has a rectangular shape.

8. An actuator for an ink jet printer according to claim 6, wherein the piezoelectric/electrostrictive layer covers the vibrating plate near an intersecting point of a periphery of the notch and the longer side.

9. A method of manufacturing an actuator for an ink jet printer according to claim 6, wherein the piezoelectric/electrostrictive layer covers the vibrating plate near an intersecting point of a periphery of the notch and the longer side.

10. An actuator for an ink jet printer according to claim 1, wherein the upper electrode layer has a rectangular shape and at least one notch cut or removed by trimming along a shorter side of the upper electrode layer.

11. An actuator for an ink jet printer according to claim 1, wherein the upper electrode layer has a rectangular shape and at least one perforated portion cut or removed by trimming on a surface of the upper electrode layer.

12. An actuator for an ink jet printer according to claim 1, wherein an area of said ineffective portion is calculated in advance based upon an area where an opening portion of the cavity, the vibrating plate, and the upper electrode layer are stacked so as to adjust an ink jet volume, and to the area of said ineffective portion was added an additional area of a portion of the upper electrode layer, the portion being exposed to a direction of an edge of the thick substrate so as to actually remove the total area.

13. A method of manufacturing an actuator for an ink jet printer according to claim 1, wherein the piezoelectric/electrostrictive working portion is assembled with a piezoelectric/electrostrictive layer that has a larger plane area than the plane area of the upper electrode layer.

14. A method of manufacturing an actuator for an ink jet printer according to claim 1, wherein the upper electrode layer of rectangular shape is cut at a line connecting a point on a longer side with a point on the other longer side and one of the portions partitioned by the line is removed.

15. A method of manufacturing an actuator for an ink jet printer according to claim 1, wherein at least one notch is cut or removed by trimming along a longer side of the upper electrode layer of a rectangular shape.

16. A method of manufacturing an actuator for an ink jet printer according to claim 1, wherein at least one notch is cut or removed by trimming along a shorter side of the upper electrode layer of a rectangular shape.

17. A method of manufacturing an actuator for an ink jet printer according to claim 1, wherein at least one perforated portion is cut or removed by trimming a surface of the upper electrode layer of a rectangular shape.

18. A method of manufacturing an actuator for an ink jet printer according to claim 1, wherein an area to be removed by trimming is calculated in advance based upon an area where an opening portion of the cavity, the vibrating plate, and the upper electrode layer are stacked to adjust an ink jet volume expressible from said tank, and to the area of said ineffective portion was added an additional area of a portion of the upper electrode layer, the portion being exposed to a direction of an edge of the thick substrate to actually remove the total area.

19. An actuator for an ink jet printer comprising:

an ink tank comprising a thick substrate having a cavity and a vibrating plate covering the cavity; and a piezoelectric/electrostrictive working portion comprising an upper electrode layer, a lower electrode layer, and a piezoelectric/electrostrictive layer between said electrode layers, the piezoelectric/electrostrictive working portion being disposed on the ink tank so that the lower electrode layer contacts with the vibrating plate;

wherein the upper electrode layer comprises an effective portion and a trimmed or ineffective portion and the piezoelectric/electrostrictive layer covering the vibrating plate comprises an effective working portion and or ineffective portion located, said ineffective portion being located near the ineffective portion of the upper electrode layer.

20. An actuator for an ink jet printer according to claim 19, wherein the piezoelectric/electrostrictive layer has a larger plane area than the upper electrode layer.

21. An actuator for an ink jet printer according to claim 19, wherein the upper electrode layer has a rectangular shape, and the upper electrode layer is separated into said effective and ineffective portions at a line connecting a point on a longer side with a point on the other longer side or said ineffective portion is removed.

22. An actuator for an ink jet printer according to claim 21, wherein the piezoelectric/electrostrictive layer covers the vibrating plate on an extension line of said line.

23. A method of manufacturing an actuator for an ink jet printer according to claim 21, wherein the piezoelectric/electrostrictive layer covers the vibrating plate on an extension line of said line which partitions said upper electrode layer.

24. An actuator for an ink jet printer according to claim 19, wherein the upper electrode layer has a rectangular shape and at least one notch cut or removed by trimming along a longer side of the upper electrode layer.

25. An actuator for an ink jet printer according to claim 24, wherein the notch has a rectangular shape.

26. An actuator for an ink jet printer according to claim 19, wherein the upper electrode layer has a rectangular shape and at least one notch cut or removed by trimming along a shorter side of the upper electrode layer.

27. An actuator for an ink jet printer according to claim 19, wherein the upper electrode layer has a rectangular shape and at least one perforated portion cut or removed by trimming on a surface of the upper electrode layer.

28. An actuator for an ink jet printer according to claim 19, wherein an area to be removed by trimming is calculated in advance based upon an area where an opening portion of the cavity, the vibrating plate, and the upper electrode layer are stacked so as to adjust an ink jet volume, and to the area of said ineffective portion was added an additional area of a portion of the upper electrode layer, the portion being exposed to a direction of an edge of the thick substrate so as to actually remove the total area.

29. A method of manufacturing an actuator for an ink jet printer according to claim 19, wherein the piezoelectric/electrostrictive layer working portion is assembled with a piezoelectric/electrostrictive layer that has a larger plane area than the plane area of the upper electrode layer.

30. A method of manufacturing an actuator for an ink jet printer according to claim 19, wherein the upper electrode layer of rectangular shape, is cut at a line connecting a point on a longer side with a point on the other longer side and one of the portions partitioned by the line is removed.

31. A method of manufacturing an actuator for an ink jet printer according to claim 19, wherein at least one notch is cut or removed by trimming along a longer side of the upper electrode layer of a rectangular shape.

32. A method of manufacturing an actuator for an ink jet printer according to claim 19, wherein at least one notch is cut or removed by trimming along a shorter side of the upper electrode layer of a rectangular shape.

33. A method of manufacturing an actuator for an ink jet printer according to claim 19, wherein at least one perforated portion is cut or removed by trimming on a surface of the upper electrode layer of a rectangular shape.

34. A method of manufacturing an actuator for an ink jet printer according to claim 19, wherein an area to be removed is calculated in advance based upon an area where an opening portion of the cavity, the vibrating plate, and the upper electrode layer are stacked to adjust an ink jet volume expressible from said tank, and to the area of said ineffective portion was added an additional area of a portion of the upper electrode layer, the portion being exposed to a direction of an edge of the thick substrate to actually remove the area.

35. A method of manufacturing an actuator for an ink jet printer comprising:

assembling an ink tank comprising a thick substrate having a cavity and a vibrating plate covering the cavity; and assembling a piezoelectric/electrostrictive working portion comprising an upper electrode layer, a lower electrode layer, and a piezoelectric/electrostrictive layer between said electrode layers, the piezoelectric/electrostrictive working portion being disposed on the ink tank so that the lower electrode layer contacts with the vibrating plate;

reducing an effective area of the upper electrode in a region where the piezoelectric/electrostrictive layer covers the vibrating plate thereby adjusting an ink jet volume expressible from said tank.

36. A method of manufacturing an actuator for an ink jet printer comprising:

assembling an ink tank comprising a thick substrate having a cavity and a vibrating plate covering the cavity; and assembling a piezoelectric/electrostrictive working portion comprising an upper electrode layer, a lower electrode layer, and a piezoelectric/electrostrictive layer between said electrode layers, the piezoelectric/electrostrictive working portion being disposed on the ink tank so that the lower electrode layer contacts with the vibrating plate;

reducing a total area of the upper electrode layer and reducing a total area of the piezoelectric/electrostrictive layer covering the vibrating plate in a region near the area of the upper electrode layer reduced, thereby adjusting an ink jet volume expressible from said tank.

* * * * *